US007628822B2

(12) United States Patent
Taylor

(10) Patent No.: US 7,628,822 B2
(45) Date of Patent: Dec. 8, 2009

(54) FORMATION OF PATTERNS OF FADES ON FABRICS

(76) Inventor: Lawnie H. Taylor, 14421 Brookmead Dr., Germantown, MD (US) 20874

( * ) Notice: Subject to any disclaimer, the term of this patent is extended or adjusted under 35 U.S.C. 154(b) by 259 days.

(21) Appl. No.: 11/101,433

(22) Filed: Apr. 8, 2005

(65) Prior Publication Data

US 2006/0225224 A1 Oct. 12, 2006

(51) Int. Cl.
*D06L 3/06* (2006.01)

(52) U.S. Cl. ..... 8/102; 8/107; 8/111; 8/115.51; 8/116.1; 252/8.86; 252/187.24

(58) Field of Classification Search ..... 252/8.86, 252/187.24; 8/115.51, 101, 102, 107, 111, 8/116.1

See application file for complete search history.

(56) References Cited

U.S. PATENT DOCUMENTS

| | | | | |
|---|---|---|---|---|
| 1,514,068 | A | | 11/1924 | Phair |
| 3,929,661 | A | | 12/1975 | Nakagawa et al. |
| 4,474,677 | A | * | 10/1984 | Foxlee ..... 252/187.25 |
| 4,554,091 | A | | 11/1985 | Jones et al. |
| 4,622,037 | A | | 11/1986 | Streit et al. |
| 4,740,213 | A | * | 4/1988 | Ricci ..... 8/108.1 |
| 4,832,864 | A | | 5/1989 | Olson |
| 4,888,323 | A | | 12/1989 | Matsuda et al. |
| 4,912,056 | A | | 3/1990 | Olson |
| 4,929,383 | A | | 5/1990 | Haendler |
| 5,006,126 | A | | 4/1991 | Olson et al. |
| 5,075,029 | A | | 12/1991 | Haendler |
| 5,104,571 | A | * | 4/1992 | Cramer ..... 252/187.24 |
| 5,122,159 | A | | 6/1992 | Olson et al. |
| 5,131,915 | A | * | 7/1992 | Mendoza ..... 8/457 |
| 5,250,512 | A | | 10/1993 | Ohmoto et al. |
| 5,287,960 | A | | 2/1994 | Kalb et al. |
| 5,567,207 | A | | 10/1996 | Lockman et al. |
| 5,573,710 | A | | 11/1996 | McDonell et al. |
| 5,604,751 | A | | 12/1997 | Kato et al. |
| 5,731,276 | A | | 3/1998 | Argo et al. |
| 5,746,936 | A | | 5/1998 | Mercado |
| 5,814,591 | A | | 9/1998 | Mills et al. |
| 5,830,839 | A | | 11/1998 | Scepanski |
| 5,843,190 | A | | 12/1998 | Agostini et al. |
| 5,872,090 | A | | 2/1999 | You et al. |
| 5,877,315 | A | | 3/1999 | Deline et al. |
| 5,904,735 | A | | 5/1999 | Gutierrez et al. |
| 5,972,876 | A | | 10/1999 | Robbins et al. |
| 5,997,585 | A | | 12/1999 | Scialla et al. |
| 6,004,916 | A | | 12/1999 | Mills et al. |
| 6,090,770 | A | | 7/2000 | Mendoza et al. |
| 6,120,555 | A | | 9/2000 | Scialla et al. |
| 6,153,120 | A | | 11/2000 | Scialla et al. |
| 6,200,941 | B1 | | 3/2001 | Strandburg et al. |
| 6,204,235 | B1 | | 3/2001 | Jimenez et al. |
| 6,211,131 | B1 | | 4/2001 | Kaaret et al. |
| 6,214,784 | B1 | | 4/2001 | Robbins et al. |
| 6,277,153 | B1 | | 8/2001 | Van Kouwen et al. |
| 6,297,209 | B1 | | 10/2001 | Kaaret et al. |
| 6,398,077 | B1 | | 6/2002 | Gross et al. |
| 6,413,925 | B2 | | 7/2002 | Akbarian et al. |
| 6,416,687 | B1 | | 7/2002 | Agostini et al. |
| 6,448,215 | B1 | | 9/2002 | Grande et al. |
| 6,468,954 | B2 | | 10/2002 | Levitt et al. |
| 6,506,718 | B1 | | 1/2003 | Todini |
| 6,537,960 | B1 | | 3/2003 | Ruhr et al. |
| 6,624,134 | B1 | | 9/2003 | Briatore et al. |
| 6,648,215 | B2 | | 11/2003 | Leu |
| 6,649,583 | B2 | | 11/2003 | Todini |
| 6,774,098 | B2 | | 8/2004 | Taylor |
| 6,916,771 | B2 | | 7/2005 | Ajmani et al. |
| 6,946,435 | B1 | | 9/2005 | Taylor |
| 7,109,157 | B2 | | 9/2006 | Taylor |
| 7,288,616 | B2 | | 10/2007 | Tamareselvy |
| 2002/0189633 | A1 | | 12/2002 | Powers et al. |
| 2003/0171234 | A1 | | 9/2003 | Ajmani et al. |
| 2004/0072712 | A1 | | 4/2004 | Man |
| 2004/0168260 | A1 | | 9/2004 | Taylor |
| 2006/0225224 | A1 | | 10/2006 | Taylor |
| 2006/0281657 | A1 | | 12/2006 | Taylor |
| 2007/0287652 | A1 | | 12/2007 | Taylor |

FOREIGN PATENT DOCUMENTS

| | | | |
|---|---|---|---|
| JP | 10081156 | A | 3/1998 |
| JP | 11034693 | A | 2/1999 |
| JP | 2005-212512 | A | 8/2005 |
| WO | 2006/110326 | | 10/2006 |
| WO | 2007/142640 | | 12/2007 |

OTHER PUBLICATIONS

Church & Dwight Co., Inc. Consumer Products, Specialty Products, Material Safety Data Sheet, Scrub Free Mildew Stain Remover, Issue Date Jul. 10, 2002, pp. 5.

Clorox Bleach for Institutional Use, MSDS Safety Information, Item name: Sodium Hypochlorite Solution, pp. 5, Nov. 1, 1992.

Specialty Hypochlorites vs. Commodity Bleach, Which Should You Be Using? The Olin Corporation, pp. 4, Jan. 27, 2003.

The Chlorine Institute, Sodium Hypochlorite Manual, May 2000, pp. 71.

(Continued)

*Primary Examiner*—Bernard Lipman
(74) *Attorney, Agent, or Firm*—Merchant & Gould, P.C.; Raymond Van Dyke

(57) ABSTRACT

This invention relates to a fabric having a pattern of fades and a methodology for their creation, both industrial and artistic. The fades are created by contacting at least one portion of the fabric with a hypochlorite salt-containing composition. The resulting fabric has a faded appearance either uniformly or non-uniformly. Methods, kits and a device for making a fabric having a pattern of fades are also disclosed.

31 Claims, 8 Drawing Sheets
(5 of 8 Drawing Sheet(s) Filed in Color)

OTHER PUBLICATIONS

The Clorox Company, Material Safety Data Sheet, Tilex Instant Mildew Remover, p. 1, Nov. 1992.

Jeff Kempter, sodium/calcium hypochlorite (Clorox, bleach) Chemical Fact Sheet 2/86, pp. 4, Feb. 1986.

International Search Report for PCT/US06/11413 mailed Jul. 21, 2008.

International Search Report for PCT/US06/022148 mailed Feb. 28, 2007.

Peter, M., Rouette, H.K., "Grunlagen der Textilveredlung," 1991, Deutscher Fachverlag, Frankfurt, DE, XP002420616, pp. 462-463, paragraph [7.211.1].

* cited by examiner

FORMATION OF PATTERNS OF FADES ON FABRICS

CROSS-REFERENCE TO RELATED APPLICATIONS

The present application incorporates by reference U.S. patent application Ser. No. 10/337,896, now U.S. Pat. No. 6,774,098, filed Oct. 10, 2002, entitled "Methods For Removing Stains From Fabrics Using Tetrapotassium EDTA," which claims priority to U.S. Provisional Application Ser. No. 60/423,978, filed Nov. 6, 2002, entitled "A Subclass of Aqueous, Hard Surface Cleaners Used in A New and Unobvious Soft Surface Cleaning Application." The present application also incorporates by reference U.S. patent application Ser. No. 10/612,016, filed Jul. 3, 2003, and U.S. patent application Ser. No. 10/373,787, filed Feb. 27, 2003, both of which are entitled "Methods and Equipment for Removing Stains from Fabrics."

TECHNICAL FIELD

This invention relates to a fabric having a pattern of fades and a methodology for their creation. The fades are made by exposing selected areas of the fabric to a hypochlorite salt-containing composition.

BACKGROUND

Fades on garments and other apparel are popular among all age groups, both female and male. Due to its popularity to the consumers, jean manufacturers have developed various methods to produce fades on jeans or denims to achieve a faded look. One method employs washing denims with a cellulase enzyme to release the denim's color, which produces light or white areas and lightens the dark areas (see U.S. Pat. Nos. 4,832,864, 4,912,056, 5,006,126 and 5,122,159). However, the use of enzymes to create a faded appearance can also at the same time be used to desize or shrink a fabric or garment. Thus, extra care and precision are needed if one were to employ an enzymatic approach.

Another method, as disclosed in U.S. Pat. No. 4,740,213, uses pumice stones impregnated with fluid having powerful bleaching properties to create a random faded effect on the fabric when the stones and fabric are tossed together, such as in a dryer or other tumbling apparatus. However, this process, commonly known as "stone-washing," produces uneven faded patches that vary in color shades and intensity, which, due to the random admixture, spread out in a non-uniform manner over the entire fabric being treated. These whole-fabric techniques do not permit treating specific areas of the fabric individually. Moreover, the use of strong bleaching agents is inherently harmful to the fabric.

Another technique to produce fades on fabric employs lasers. A laser method to mark and fade textiles, as disclosed in U.S. Pat. No. 5,567,207, involves exposing a textile or fabric to laser radiation of sufficient intensity. Such exposure photo-decomposes the coloring agent within the material without causing damage to the underlying textile or fabric. The pre-dyed material is scanned by a laser beam to produce uniform fading and patterns of photo-bleached marks on the textile material. Despite the possibility of great precision and potential for print-like art quality, this method is more expensive, time-consuming, and generally unavailable to consumers.

Unlike the above-mentioned methods, the present invention is simple, safe and readily available to consumers. The present invention can be done at home and allows the end users to selectively choose an area of the fabric where he or she wants to impart a customized and desired faded appearance, with a hand-art quality, either uniformly or non-uniformly. Additionally, there is a need for fabric having a pattern of fades thereon that can be customized by the consumers in a cost-effective manner and is a product of the consumers' artistic creation.

SUMMARY OF THE INVENTION

The present invention is directed to a fabric that comprises a pattern of fades produced by a method that includes (i) contacting a hypochlorite salt-containing composition on at least one portion of the fabric, wherein the hypochlorite salt-containing composition comprises an alkali metal hydroxide and a hypochlorite salt, and (ii) inactivating or removing the hypochlorite salt-containing composition from said at least one portion of the fabric to obtain a desired pattern of fades on the fabric. In one embodiment, the application of the hypochlorite salt-containing composition is performed at room temperature and the removal or inactivation of the hypochlorite salt-containing composition is achieved by a cold water wash.

In another embodiment, the hypochlorite salt-containing composition comprises an alkali metal hydroxide and a hypochlorite salt. In a preferred embodiment, the alkali metal hydroxide is sodium hydroxide and the hypochlorite salt is sodium hypochlorite. The weight concentration ratio of sodium hydroxide over sodium hypochlorite is no less than 1:12.5. In another embodiment, the weight concentration ratio of sodium hydroxide over sodium hypochlorite ranges from about 1:5 to about 5:1. In yet another embodiment, the weight concentration ratio of sodium hypochlorite over sodium hydroxide is about 2:1. In a further embodiment, the pH of the hypochlorite salt-containing composition is at least 11.8. It can also be, for example, at least 12, 12.5, or 13.

In yet another embodiment, the hypochlorite salt containing composition includes at least 0.2, 0.3, 0.5, 1, 2, 3 or higher weight percent of sodium hydroxide. In a non-limiting example, the concentration of sodium hydroxide ranges from 0.5-5.5 weight percent.

In a further embodiment, the hypochlorite salt is sodium hypochlorite whose concentration ranges from 0.1-11.0 weight percent or 1.0-2.5 weight percent. In a non-limiting example, the hypochlorite salt containing composition contains about 2.5% weight percent of sodium hypochlorite and 0.5. to 1.25 weight percent of sodium hydroxide. In another embodiment, the hypochlorite salt containing composition includes about 6 weight percent of sodium hypochlorite and 1.2 to 3 weight percent of sodium hydroxide. In yet another embodiment, the hypochlorite salt containing composition contains about 8 weight percent of sodium hypochlorite and 1.2 to 4 weight percent of sodium hydroxide. In still another embodiment, the hypochlorite salt containing composition includes about 11 weight percent of sodium hypochlorite and up to 5.5 weight percent of sodium hydroxide.

The hypochlorite salt-containing composition can be applied for successive intervals to produce successive faded hues. It can be applied as a liquid or a gel. In addition, it can be applied by means of a gel stick, microspray jet, fabric dye brush or any other appropriate applicators for generating artwork on a canvass. The duration of the application may depend on the formation of faded hues, as pre-determined by the end user. In a non-limiting example, the duration of application ranges from at least 1 minute to 30 minutes.

The hypochlorite salt-containing composition can be employed in various concentrations on a given fabric. The duration of application to achieve the formation of a variety of faded hues on a fabric can be standardized, such as in a commercial usage of the present invention. Instead of multiple, time-spaced passes over the fabric applying the full strength composition, one application from multiple sources of varying concentrations to achieve the desired variegated effect can be put down, thereby minimizing handling of the fabric and simplifying the production process. At the end of a predetermined treatment time, the treated fabric can be inactivated, such as by cold water immersion.

In one embodiment, the formation of the fades pattern on the fabric is dyed with another color or left as the fabric base color. It can be formed by means of free hand, template guide or machine operation. A preferred fabric is cotton and preferred garments are denim jeans or trousers.

In another embodiment, a method and a kit for the production of fabric having a pattern of fades are also provided in the present invention.

In a further embodiment, a device to manufacture the fabric having a pattern of fades is also contemplated. The device of the present invention includes a surface where the fabric is placed upon and at least one dispenser disposed adjacent to the surface. To produce a pattern of fades on the fabric, at least one dispenser relatively moves to the fabric and applies the hypochlorite salt-containing composition to the fabric. In addition, at least one dispenser may include a plurality of dispensers that relatively moves to the fabric and applies a hypochlorite salt-containing composition to the fabric. The device may further include at least one template that is placed atop the fabric. The hypochlorite salt-containing composition is applied through the template to form the pattern of fades on the fabric. The device may still further include a vat that is adjacent to the surface. After being in contact with the hypochlorite salt-containing composition, the treated fabric is inactivated, such as by cold water immersion in the vat.

Other features, objects, and advantages of the present invention are apparent in the detailed description that follows. It should be understood, however, that the detailed description, while indicating embodiments of the present invention, is given by way of illustration only, not limitation. Various changes and modifications within the scope of the invention will become apparent to those skilled in the art from the detailed description.

BRIEF DESCRIPTION OF THE DRAWINGS

The patent or application file contains at least one drawing executed in color. Copies of this patent or patent application publication with color drawings (FIGS. 1-5) will be provided by the Office upon request and payment of the necessary fee. The drawings are provided for illustration, not limitation.

DETAILED DESCRIPTION OF THE INVENTION

Figure 1:
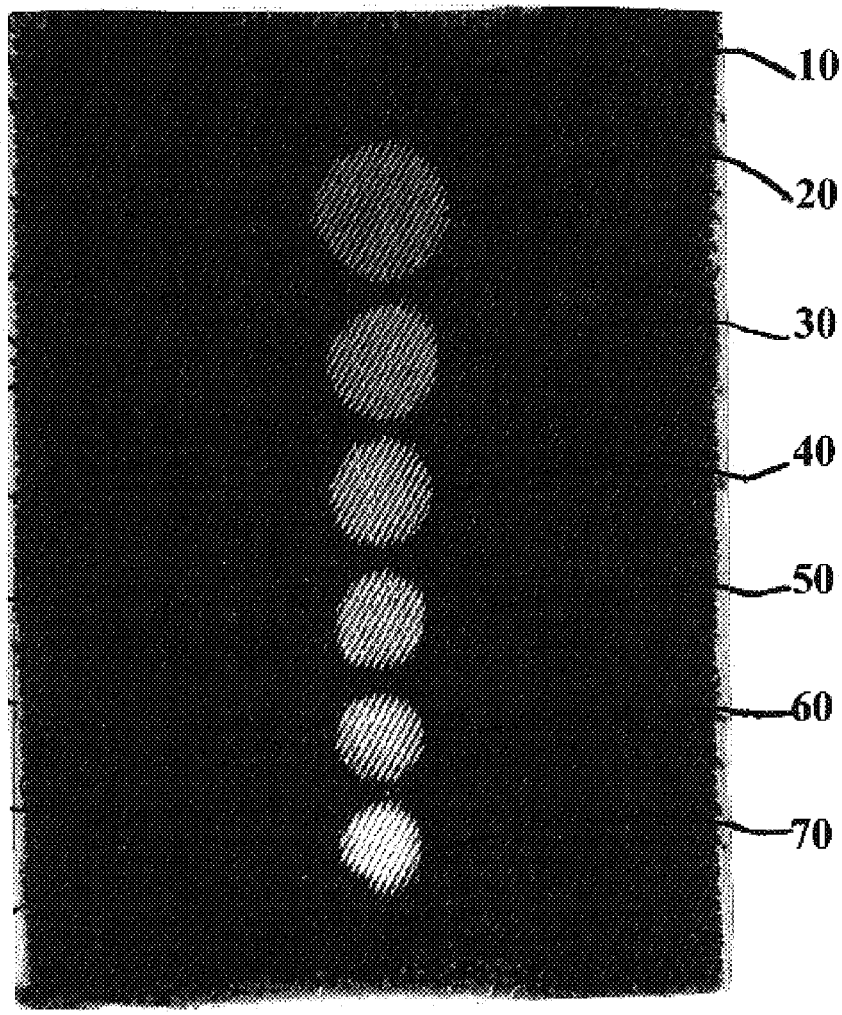
FIG. 1 is frontal view of a denim patch that has been treated with a 6% hypochlorite salt-containing composition for 1.5 to 30 minutes, pursuant to the present invention. Reference numerals 10 and 70 show dark blue and white patches, respectively.
Figure 2:
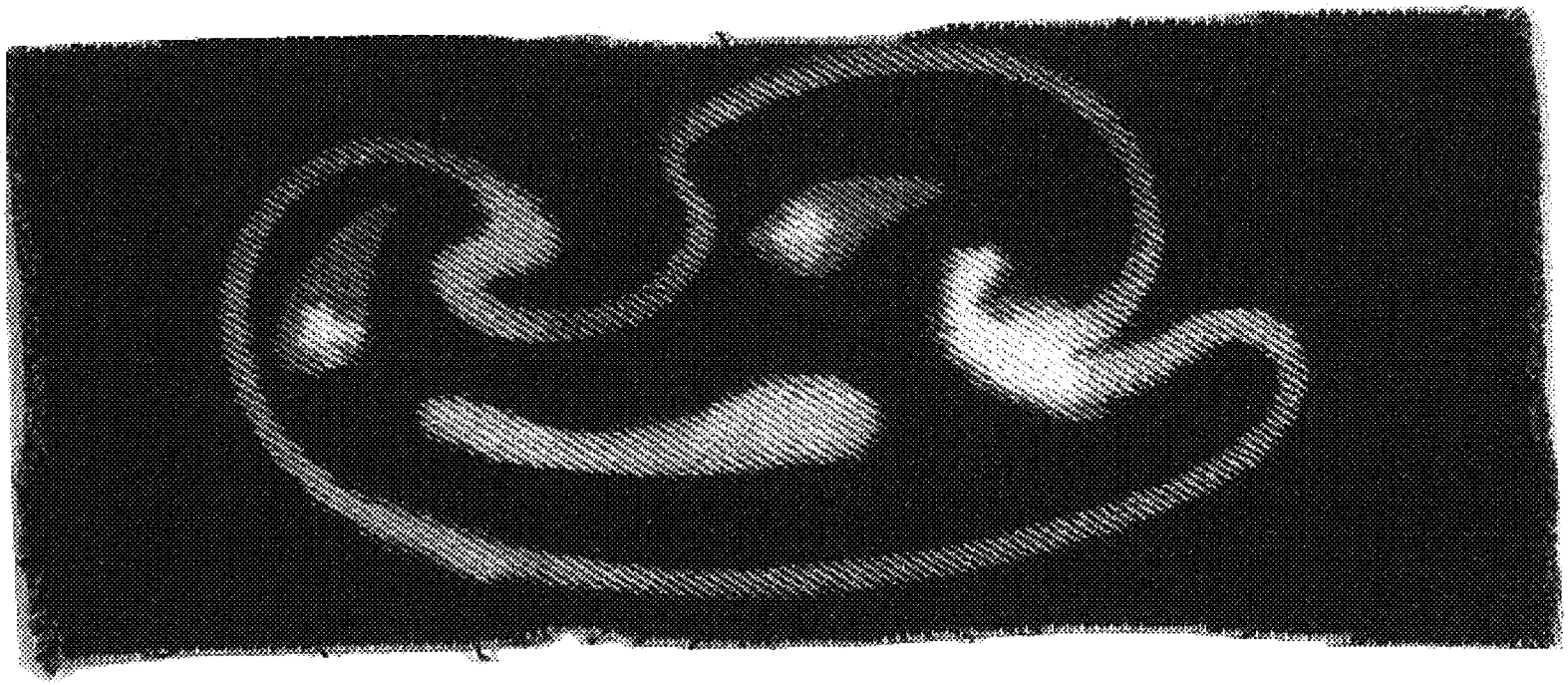
FIG. 2 is a frontal view of a faded denim patch of a first fade artwork labeled as "The Comic;"
Figure 3:
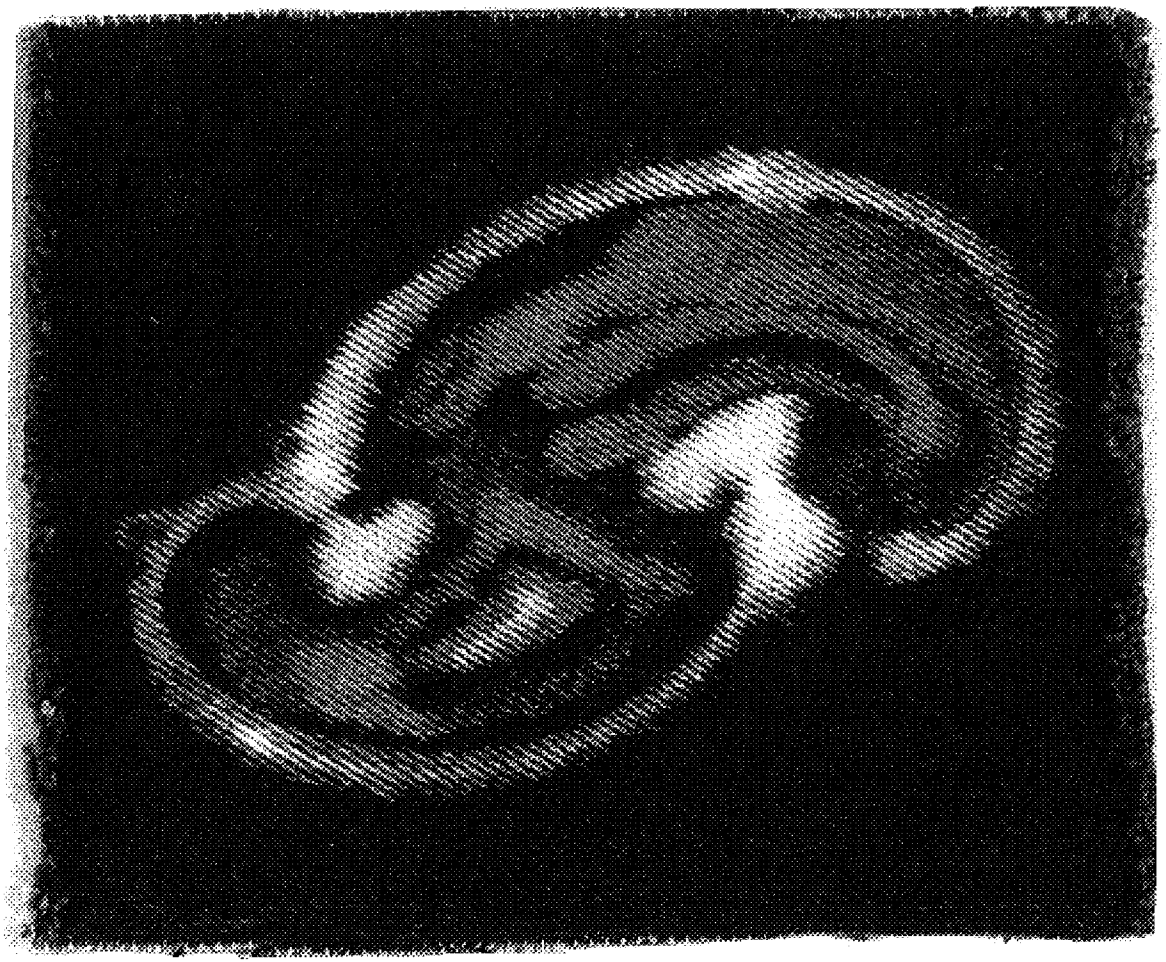
FIG. 3 is a frontal view of a faded denim patch of a second fade artwork labeled as the "Eye of the Hurricane;"
Figure 4:
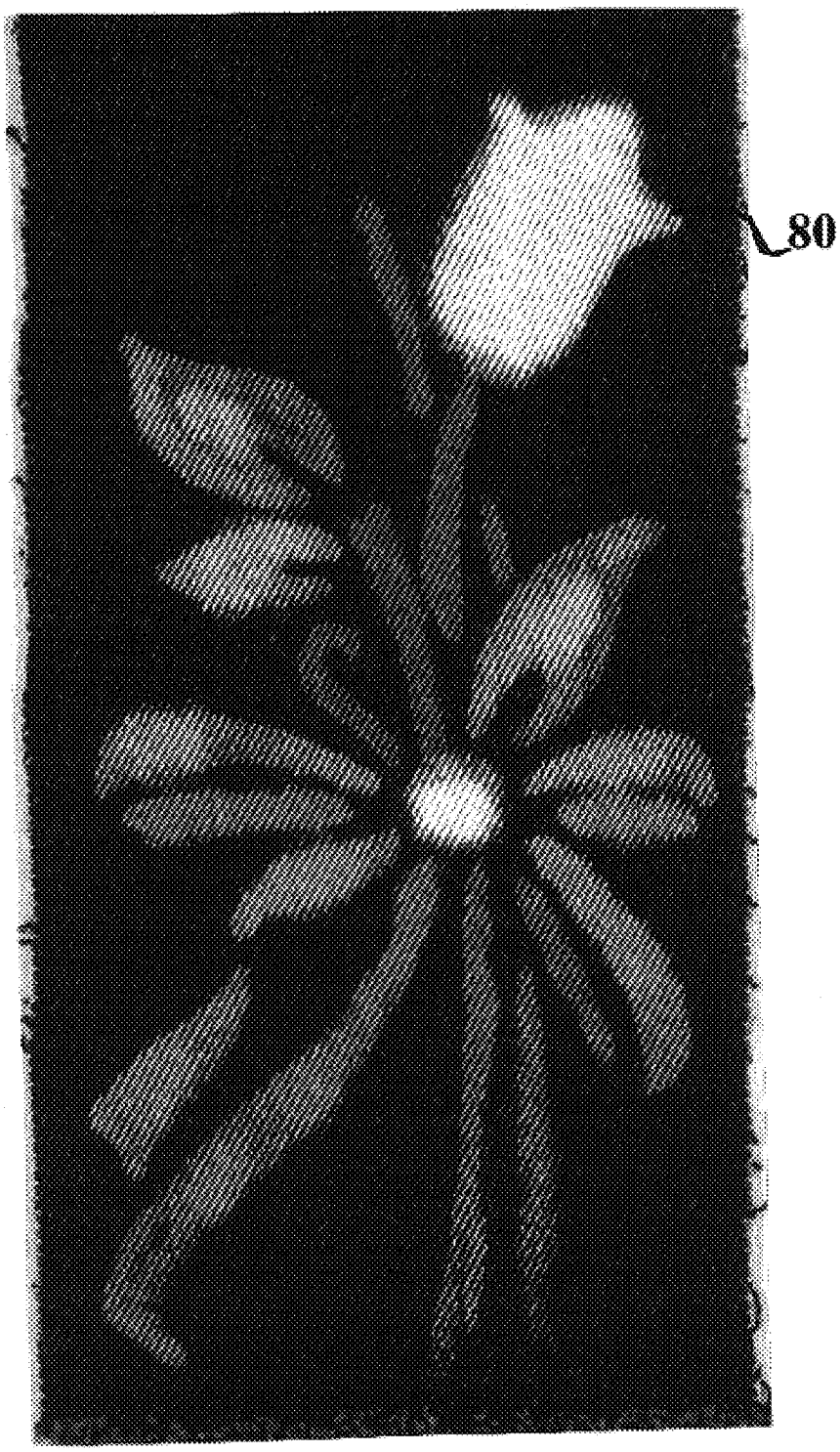
FIG. 4 is a frontal view of a faded denim patch showing of a third fade artwork labeled as the "Blossom and Bow;"
Figure 5:
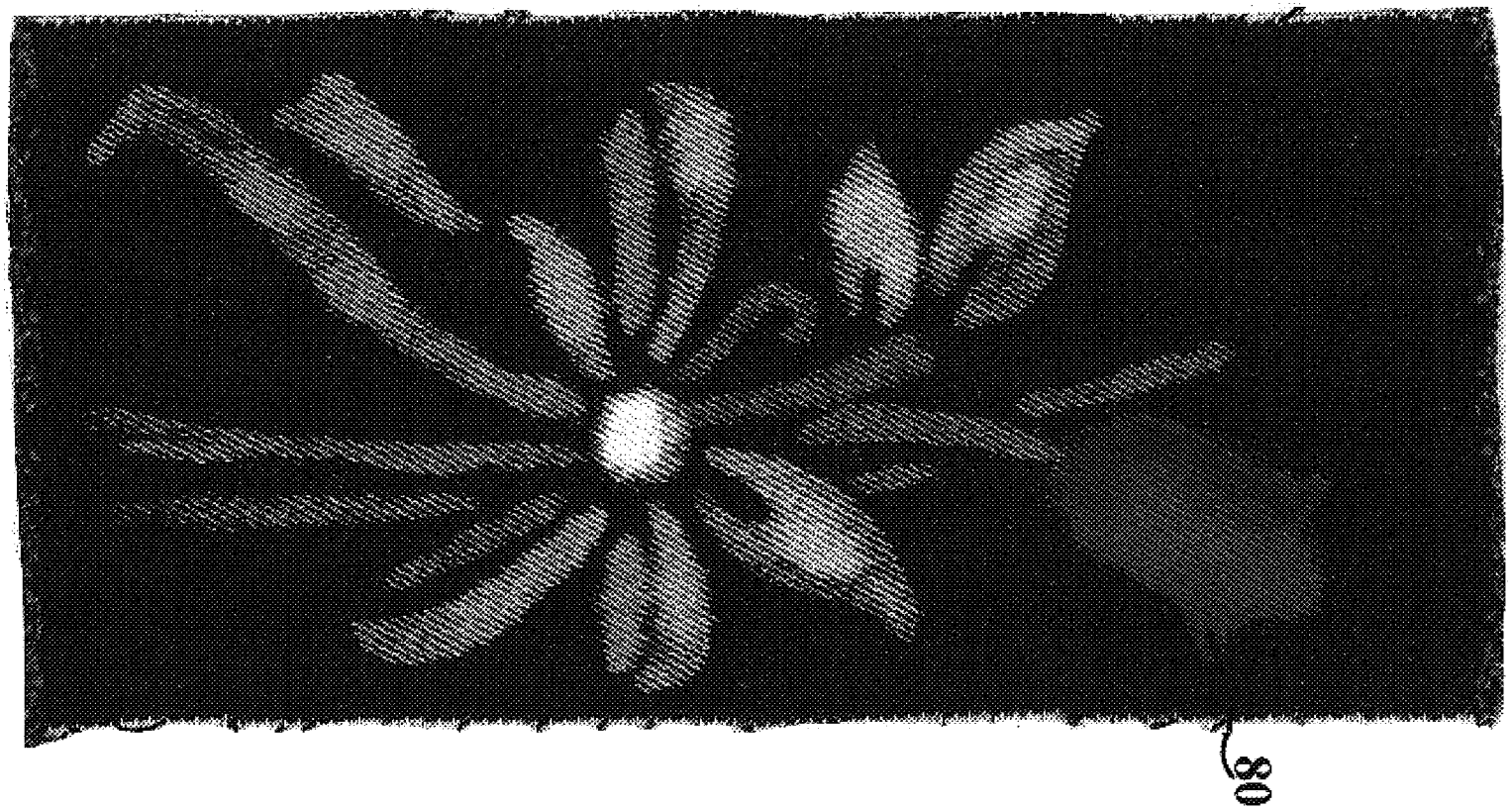
FIG. 5 is a frontal view of the fade artwork of FIG. 4, wherein another dye color (red) is applied to a bleached-out section of the fabric portraying the flower blossom.

The present invention is based on the surprising discovery that a hypochlorite salt-containing composition, which contains a metallic salt of hypochlorous acid and an appropriate amount of alkali metal, can not only be used as a cleaning composition but can also be used to non-destructively and conveniently create a pattern of fades on a fabric. The fades are formed by the application of the hypochlorite salt-containing composition on one or more selected portion(s) of the fabric. The fades action can be stopped by removal, dilution, or otherwise inactivation of the hypochlorite salt-containing composition when a desired fades formation is produced.

Without limiting the present invention to any particular mechanism, Applicant has found that alkali metal hydroxide (such as sodium hydroxide) adds significantly to the cleaning power of sodium hypochlorite to remove stains, such as menstrual fluid or underarm perspiration stains, from clothes and other soft fabric articles, while significantly increasing the compatibility of sodium hypochlorite with soft fabric, such as cotton fabric, thereby preventing sodium hypochlorite from damaging the fabric. The discovery of the hypochlorite salt-containing composition as an effective cleaning composition is disclosed in co-pending U.S. patent application Ser. Nos. 10/373,787 and 10/612,016, incorporated by reference herein.

The metallic salt of hypochlorous acid preferably is sodium hypochlorite. The alkali metal hydroxide preferably is sodium hydroxide. It should, of course, be understood that other hypochlorous salts and/or alkali metal hydroxides can also be used in the present invention.

Sodium hypochlorite (NaOCl) dissolves in water to sodium and hypochlorite ions. The hypochlorite ion is a strong oxidant which can react with numerous materials. The stability of the sodium hypochlorite composition is affected by the pH of the composition. It has been reported that sodium hypochlorite is the most stable when the pH of the composition is between 11 to 13. Such a high pH can be created by adding excess alkali metal hydroxide, such as sodium hydroxide, to the sodium hypochlorite composition. Thus, the pH of the hypochlorite salt-containing composition preferably is at least about 11.8. For instance, the pH of the hypochlorite salt-containing composition can be at least 12, 12.5 or 13. In one embodiment, the pH of the hypochlorite salt-containing composition is about 13.

The decomposition rate of the hypochlorite ion increases when the pH of the composition falls below 11. This is because of the rapid acid-catalyzed decomposition pathway of the hypochlorite ion. The rate of decomposition also increases when the pH of the composition is over 13. This is due to the increase in the ionic strength of the composition caused by the increased level of excess alkali metal hydroxide added to the composition. The present invention finds, however, that even with a high ionic strength, the sodium hypochlorite/sodium hydroxide composition is effective in imparting a faded appearance on the fabric without any significant damaging effects. In addition, Applicant has found that addition of appropriate amounts of alkali metal hydroxide to a hypochlorite composition retards the damaging effect of the hypochlorite composition on soft fabric (such as cotton fabric).

The concentration of sodium hypochlorite in the hypochlorite salt-containing composition of the present invention is preferably at least 0.1% by weight, based on the total weight of the hypochlorite salt-containing composition. For instance, the concentration of sodium hypochlorite can be at least 0.5, 1, 2, 3, 4, 5, 6, 7 or 8% by weight. In one embodiment, the concentration of sodium hypochlorite ranges from 0.1 to 11% by weight. In another embodiment, the concentration of sodium hypochlorite is about 0.5 to 5% by weight. In yet another embodiment, the concentration of sodium hypochlorite is about 1 to 2.5% by weight. In still another embodiment, the concentration of sodium hypochlorite is about 1.5 to 2% by weight.

The concentration of sodium hydroxide in the hypochlorite salt-containing composition preferably is at least 0.2% by weight, based on the total weight of the hypochlorite salt-containing composition. For instance, the concentration of sodium hydroxide can be at least about 0.3, 0.4, 0.5, 1, 1.5, 2, 2.5, 3, 4 or 5% by weight. In one embodiment, the concentration of sodium hydroxide ranges from about 0.5 to about 5.5% by weight. In another embodiment, the concentration of sodium hydroxide ranges from about 1 to 2% by weight. It is generally known that an appropriate amount of alkali metal hydroxide (such as sodium hydroxide) increases the stability of sodium hypochlorite in the hypochlorite salt-containing composition.

Applicant has discovered that the weight concentration ratio of sodium hydroxide over sodium hypochlorite may vary substantially without affecting the ability of the hypochlorite salt-containing composition to form pattern of fades on fabrics. Preferably, the weight concentration ratio of sodium hydroxide over sodium hypochlorite is no less than 1:12.5. For instance, the weight concentration ratio of sodium hydroxide over sodium hypochlorite can be no less than 1:10, 1:5, 1:2.5 or 1:1.

In one embodiment, the weight concentration ratio of sodium hydroxide over sodium hypochlorite can range from about 1:5 to about 5:1. In another embodiment, the weight concentration ratio of sodium hydroxide over sodium hypochlorite is about 1:3 to about 1:1. For instance, the weight concentration ratio of sodium hydroxide over sodium hypochlorite can be about 1:2.

In another embodiment, the hypochlorite salt-containing composition includes about 6 weight percent of sodium hypochlorite and 1.2 to 3 weight percent of sodium hydroxide. In another embodiment, the hypochlorite salt-containing composition includes about 2.5 weight percent of sodium hypochlorite and 0.5 to 1.25 weight percent of sodium hydroxide. In still another embodiment, the hypochlorite salt containing composition contains about 8 weight percent of sodium hypochlorite and 1.2 to 4 weight percent of sodium hydroxide. In yet another embodiment, the hypochlorite salt containing composition includes about 11 weight percent of sodium hypochlorite and up to 5.5 weight percent of sodium hydroxide.

Other ingredients or additives can be added in the hypochlorite salt-containing composition. These ingredients or additives include, for example, chelating agents, phosphorous-containing salts, surfactants, or abrasive agents. These ingredients or additives, however, are not necessary for the fading formation function of the hypochlorite salt-containing composition. In one embodiment, the hypochlorite salt-containing composition is substantially free of chelating agents, phosphorous-containing salts, surfactants, and abrasive agents.

The hypochlorite salt-containing composition can be applied for successive intervals to produce successive hues of fades. In one embodiment, the application of the hypochlorite salt-containing composition is performed at room temperature (e.g., 68-72° F. or 21-23° C.) and the inactivation process can be achieved by a cold water wash.

The composition of the present invention can be applied on the fabric as a liquid or gel by means of a fabric dye brush, gel stick, spray jet, e.g., microspray jet, or any other appropriate applicators for generating artwork on a canvass. In a non-limiting example, the duration of the application ranges from at least 1 min-30 min. In another example, an application time of less than 15 minutes produces partially bleached-out (dark) fades while an application time of approximately 30 minutes produces totally bleached-out (white) fades. In another embodiment, the faded pattern is dyed with another color or left as the fabric base color, typically white.

The fabric patterns formed by the hypochlorite salt-containing composition can be applied onto the fabric in a uniform and non-uniform faded manner to achieve a variety of effects. For example, contacting the fabric at certain duration with the hypochlorite salt-containing composition in a non-uniform manner produces an uneven faded appearance. Also, one can spot treat the pockets or certain sections of the denim jeans with the hypochlorite salt-containing composition at a certain time frame, while leaving the remainder of the fabric untreated, to produce an overall uneven or targeted faded look. Alternatively, one can evenly expose the entire fabric to a hypochlorite salt-containing composition to create a homogeneous faded appearance over the entire fabric.

In another embodiment, the present invention includes a method to produce a fabric having a pattern of faded hues. This method includes, for example, the steps of (i) contacting a hypochlorite salt-containing composition on at least one portion of the fabric, wherein the hypochlorite salt-containing composition comprises an alkali metal hydroxide. and a hypochlorite salt, and (ii) inactivating or removing the hypochlorite salt-containing composition from at least one portion of the fabric to obtain a desired pattern of fades on the fabric. The step of contacting the fabric with the hypochlorite salt-containing composition is performed at either a fixed concentration or varying concentrations of the hypochlorite salt-containing composition. The present invention can also further comprise contacting the fabric with the hypochlorite salt-containing composition by means of free hand, a template guide or machine operation.

The hypochlorite salt-containing composition of the present invention is available to consumers as a kit. The kit preferably includes a container of the hypochlorite salt-containing composition (e.g., in a spray bottle, gel stick, spray jet, e.g., a microspray jet, or any other appropriate applicators for generating artwork on a canvass), a flat fabric dye brush made of synthetic fiber, a labeled container box and an instruction sheet.

Sodium hypochlorite and sodium hydroxide can be separately stored prior to use. For instance, they can be stored in two separate compartments of a common container. The first compartment encloses a sodium hypochlorite composition, which preferably has a pH of between 11 and 13. The second compartment encloses a concentrated sodium hydroxide composition. The two compositions are mixed together upon use. An exemplary device suitable for this purpose is illustrated in U.S. Pat. No. 6,398,077, which is incorporated herein by reference. The two compositions may also, of course, be stored separately and mixed together in one of the containers or admixed into a third container.

In a further embodiment, the present invention contemplates a device for producing a pattern of fades on the fabric. The device comprises a surface where the fabric rests upon and at least one dispenser disposed adjacent to the surface. To form the pattern of fades according to the present invention, at least one dispenser relatively moves to the fabric and applies the hypochlorite salt-containing composition to the fabric. It should be understood that a plurality of dispensers that relatively moves to the fabric may be employed to apply a hypochlorite salt-containing composition to the fabric. The device may further include at least one template that is placed atop the fabric. The hypochlorite salt-containing composition is applied through the template to form the pattern of fades on the fabric. The device may still further include a vat that is adjacent to the surface. After being in contact with the hypochlorite salt-containing composition, the treated fabric is inactivated, such as by cold water immersion in the vat.

Fabrics suitable for the present invention can be made of a variety of materials, such as cotton, cotton/polyester, corduroy, rayon, canvas, linen, nylon, acrylic, flax, hemp, jute, ramie, polyester, polyamide, acrylic, polyvinyl chloride and polyolefin. A preferred fabric is cotton. In addition, the fabric can be a garment or other apparel, carpet, tote bags, curtains, towels, bed clothing, indoor or outdoor protective covers or various wall-covering fabrics to name but a few of the potential fabrics. The garment or apparel items can be a dress, work wear, coveralls, denim or jeans, jacket, pants, gloves, undergarments, socks, hats, skirts, aprons, head coverings, and T-shirts. A preferred garment or apparel is a denim or jeans.

The gradation of hues or fades is best illustrated with respect to FIG. 1, where the dark blue denim fabric is dyed using the hypochlorite salt-containing composition of the present invention. The dark hue of the untreated fabric, generally indicated by the reference numeral 10, is the untreated state of the color, which in this example is dark blue, as indicated in the color version of the Drawings submitted herewith. As noted above, treatment of the fabric with the hypochlorite salt-containing composition of the present invention at varying time intervals or treatment strengths results in patches of treated fabric of varying hues, such as also depicted in FIGS. 2-5 described hereinbelow.

As indicated in FIG. 1, applying the composition to the fabric for a short period or at reduced concentration strength results in a patch having a lighter hue, generally indicated by the reference numeral 20, which is a lighter shade of blue in this example. Further application of the composition, either for longer times, greater concentration strengths or both, results in additional patches of increasingly lighter hues, generally indicated by the reference numerals 30, 40, 50, and 60, respectively, until the color is substantially or entirely removed, as is designated by the reference numeral 70.

With reference to FIGS. 2-5, the varying application of the hypochlorite salt-containing composition of the present invention onto the untreated fabric results in a variety of patterns of varying hues. As indicated, the patterns can be enhanced by use of a template guide or applique to better control the treatment process and standardize the production process.

In one embodiment of the present invention, a consumer can purchase a kit containing the aforedescribed hypochlorite salt-containing composition along with instructions for use. Templates of patterns may also be purchased or constructed by the user. It should be understood that the user may employ the instant invention in a wide variety of artistic expression, creating patterns on fabrics of all types. As discussed, the principles of the present invention can be employed on apparel or any other fabric to create patterns, messages or other expression thereon. Designs can include purely ornamental works of expression as well as practical uses, e.g., camouflage or other functional usages. Indeed, the full measure of consumer use of the instant invention is subject only to the imagination of the user, and the instant invention provides the means for this new form of expression.

In another aspect of the present invention, the fabric or apparel items can be treated in a commercial fashion, such as on an assembly line or in an automated factory. Patterns can be coded into a program and the hypochlorite salt-containing composition can be directed on the subject fabric, e.g., sprayed or otherwise applied. As discussed, a uniform strength composition can be applied in a time-delayed fashion through multiple applications at staggered times, thereby obtaining varied hues, as noted above and as discussed in more detail hereinbelow. Another approach is a single application of the composition from multiple sources and in varying strengths to the entire fabric to achieve the desired pattern, and immerse the entire fabric at the end, thereby simplifying the process for throughput, as also discussed hereinbelow. It should be understood that various percentages of the composition can be formulated, each having a particular strength to fade the fabric over a common fixed time. Additionally, it should be understood that commercial manufacturing techniques could employ multiple treatments, differing compositional strengths and timed applications in a variety of ways to achieve a desired pattern, and deactivation can also be performed by a single or multiple partial or full immersions of the treated fabric.

Figure 6:
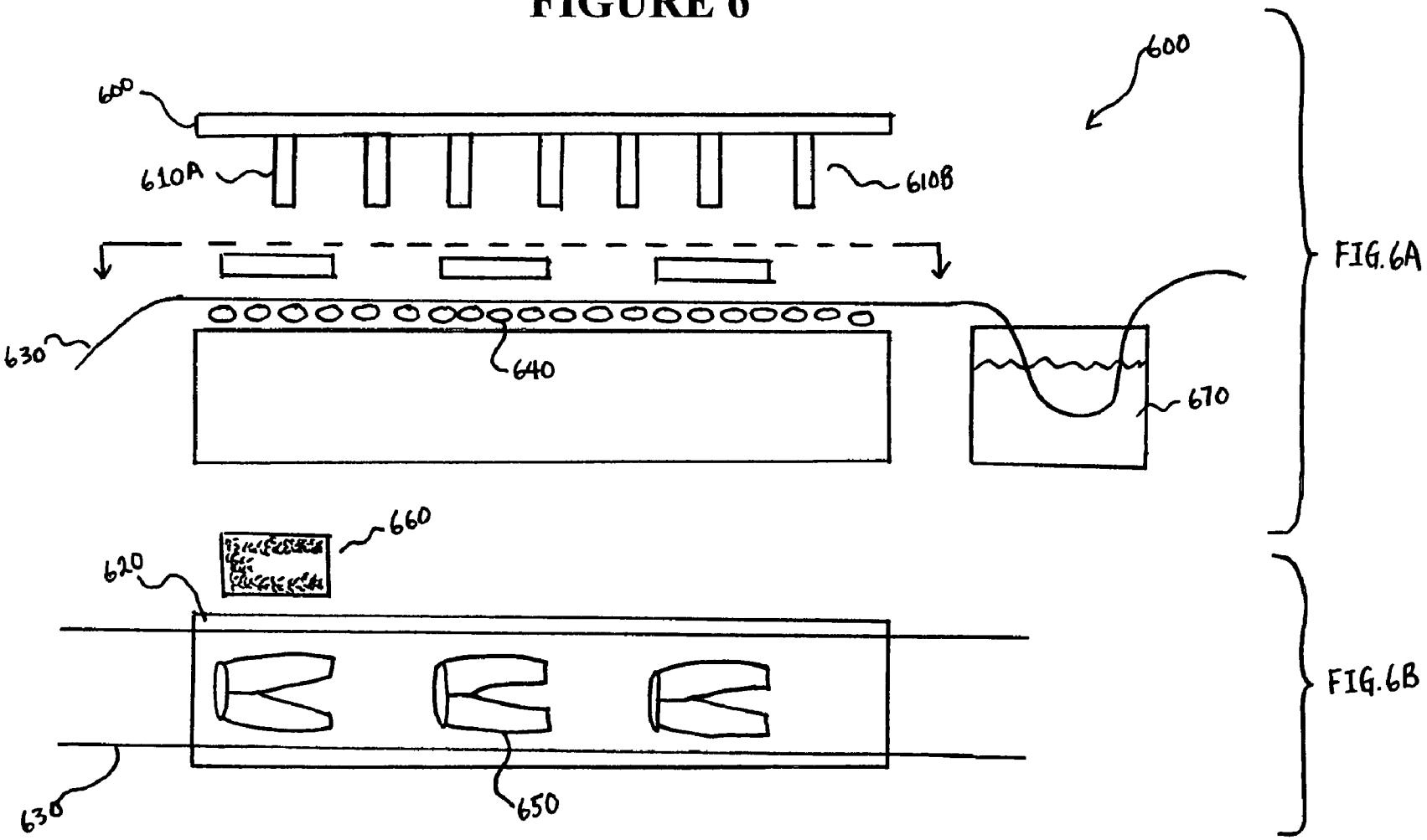
FIGS. 6A and 6B are side and top views, respectively, of a device used to produce pattern of faded hues in a fabric according to the present invention.
Figure 6A:
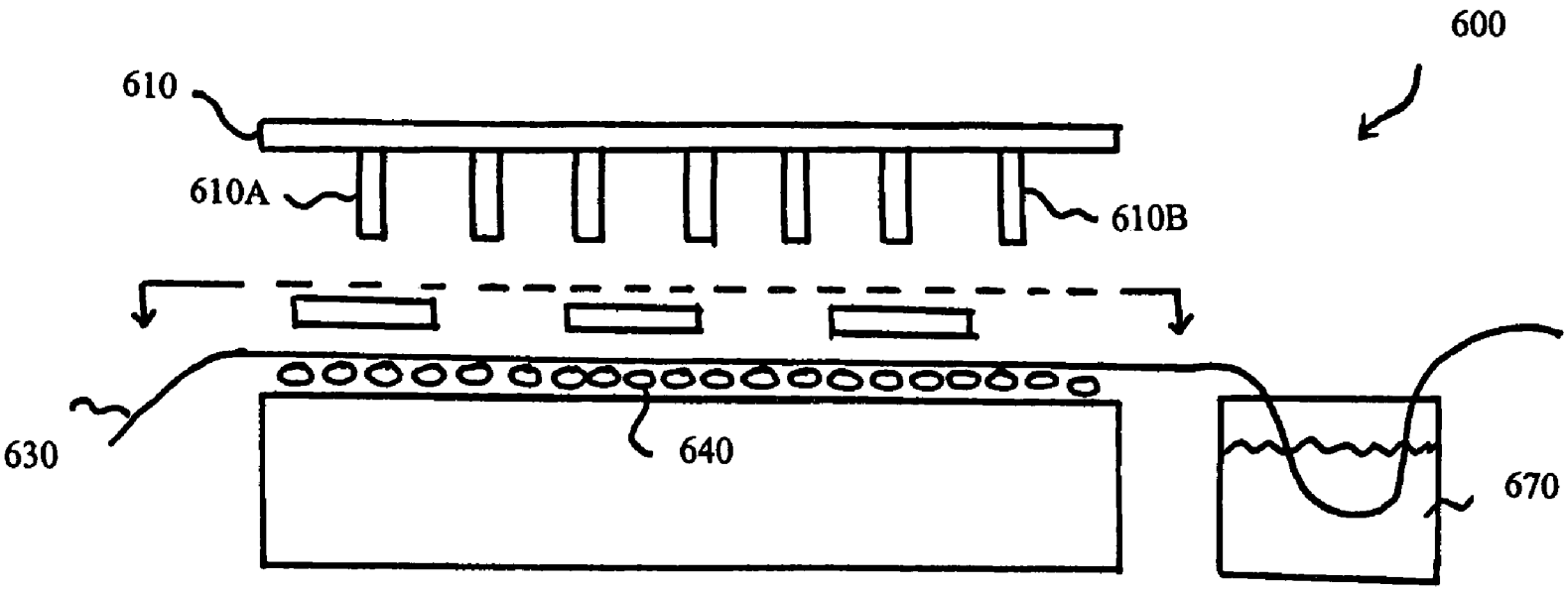

For example, in FIG. 1, as well as the remaining FIGURES, untreated fabric 10 can be passed through a device, as shown in FIG. 6A and generally designated by the reference number 600, that dispenses a weak concentration of the hypochlorite salt-containing composition to slightly dye or bleach a portion, for example, patch 20, and discrete increasing concentrations from respective dispensers to effectuate the remaining patches 30, 40, 50, 60, and the completely bleached patch 70, which has the strongest concentration composition. Instead of multiple stagings and application over time, this one-step of substantially simultaneous dyeing of the fabric 10 handles the entire fabric once, i.e., in one pass of the apparatus.

Figure 6B:
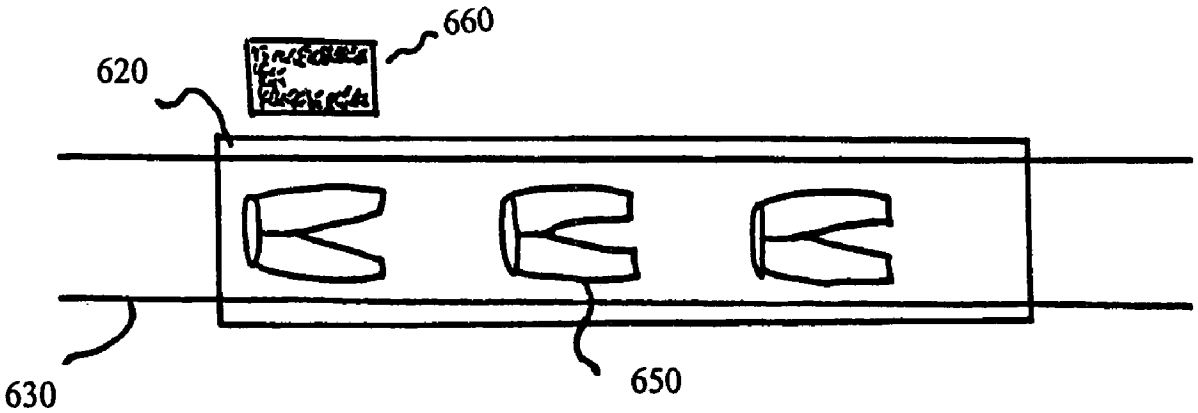

With reference now to FIGS. 6A AND 6B, device 600 employs one or more dispensers 610 that dispense the aforementioned hypochlorite salt-containing composition of the present invention in either a uniform or varying concentrations. The dispensers 610 are disposed above a surface, designated by the reference numeral 620 in FIG. 6B, and a belt or other conveyor 630, e.g., moving atop rollers 640 on surface 620. A fabric for treatment, designated by the reference numeral 650, e.g., a pair of pants as depicted in FIG. 6B, are placed atop conveyor 630 and transported adjacent the dispensers 610, preferably vertically beneath them. It should be understood that the dispensers 610 can deliver the composition of the present invention in a variety of manners, e.g., simple dripping or spraying such as from jets, as discussed hereinabove. It should also be understood that the dispensers 610 preferably move relative to the fabric for treatment. For example, the dispensers 610 can move transversely and longitudinally with respect to the fabric to position the chemical treatment thereon. The dispensers 610 may also rotate about a position to direct the composition, for example, under pressure, to the fabric at an angle, thereby covering a radial area of the subject fabric for treatment. In this manner, transverse and longitudinal movement of the dispensers 610 can be minimized or eliminated. It should also be understood that the fabric 650 can be positioned under fixed dispensers 610 and moved relative thereto, transversely and/or longitudinally, to effectuate the same treatment.

Patterns can be created on the fabric being treated using a template, designated by the reference numeral 660 in FIG. 6B. Template 660 is disposed between dispensers 610 and the fabric for treatment 650 to control the application of the composition on the fabric, as discussed hereinabove. Thus, items placed on the belt or conveyor 630 move longitudinally under the dispensers 610, which apply the composition, possibly through the template 660 to the fabric 650. After this treatment, the conveyor 630 continues to transport the fabric 650 to an adjacent vat 670. As illustrated in FIG. 6A, conveyor 630 immerses the treated fabric 650, e.g., a rinse in cold water. The conveyor 630 then transports the dyed fabric 650 for pickup. It should, of course, be understood, however, that fabrics 650 can be passed through multiple devices 600 or reprocessed through the same device 600 to effectuate creation of a desired pattern.

As shown in FIG. 6A, the dispensers 610 can employ a number of discrete dispensers to deliver the composition of the present invention in a variety of ways. For example, by time offsetting a uniform concentration solution can be employed and a dispenser 610A applies the composition to sections of the fabric 650 that are to be bleached-out or lightest. Subsequent dispensers 610 would apply the same uniform concentration composition to other sections at succeeding times, and a last dispenser 610B would apply the composition to sections that would ultimately be slightly faded and have almost the original fabric color. In this fashion, the progression of the fabrics 650 for treatment can employ a plurality of templates 660, each for directing a staged pattern portion until the last template completes the overall pattern.

It should also be understood that a plurality of fabrics 650 can be processed simultaneously, e.g., transversely in parallel across the conveyor 630 or having multiple longitudinal staging areas under the dispenser 610, where multiple identical operations proceed simultaneously or substantially simultaneously, handling a batch of fabrics 650 at once.

With reference again to FIG. 6A, the dispensers 610 can employ varying concentrations of the composition of the present invention, e.g., dispenser 610A has a full-strength concentration for application to sections of the pattern to be bleached-out or lightest. Subsequent nozzles or dispensers 610 apply weaker strength compositions to shade sections darker, i.e., less light, and the last dispenser 610B would have the weakest strength composition. A variety of templates 660 could also be employed, as discussed hereinabove. It should be understood that ordering of the dispensers 610 in this scheme is not necessarily based upon composition concentration. In this fashion, there is no need for any time delay in application of the composition, as there is in the uniform composition embodiment, and the time for fabric 650 processing in the device 600 is minimized, speeding up processing. As with the previous embodiment, multiple fabrics 650 can be handled at once in parallel and through multiple staging areas.

It should, of course, be understood that a computer software program coded to implement the aforementioned applications can be operated by a controller computer that is coupled to the device 600. The computer software program would allow the user to perform the aforementioned techniques and coordinate the various steps, e.g., setting the appropriate template 660 in place prior to application of the composition thereon, and then advancing the process accordingly. As discussed hereinabove, different design patterns to be applied to the fabric 650, as illustrated in FIGS. 2-5, can also be coded into the software program for the above-mentioned applications.

It should be understood that the above-described embodiments and the following examples are given by way of illustration, not limitation. Various changes and modifications within the scope of the present invention will become apparent to those skilled in the art from the present description.

EXAMPLES

Example 1

Creation of Jeans Fades Art to Denim Jeans Fabric

A flat dye brush (approximately 0.125×0.375×0.375 in) was used to apply the bleach in broad strokes and to make fine lines. The brush was dipped in a hypochlorite salt-containing composition, shaken to remove excess liquid and then applied to the fabric. Excessive liquid may diffuse into the adjoining areas of the pattern and may cause the loss of detail. On the other hand, insufficient liquid may require additional passes of the brush over the same area. Applications to a test fabric can be tried first to develop speed and skill. A template may be used as a guide for the application. After each section of artwork is completed, the template may be removed temporarily, if desired, to observe how the art is developing—being careful, of course, to replace the pattern exactly in the original location before continuing and be mindful of the treatment time.

Examples of the representative artwork are shown in FIGS. 2-5. Each of the artistic patterns is transferred to the fabric in any manner of orientation or depiction. With care, the delicate renderings set forth in FIGS. 2-5 can be duplicated, improved upon or otherwise altered. Representative steps to achieve the patterns of FIGS. 2-5 or any other pattern are set forth below.

| | |
|---|---|
| T = 0 min | Apply the hypochlorite salt-containing composition to sections of the pattern that are to be bleached-out, i.e., to the base color of the fabric (usually white). These sections will be allowed to bleach for 30 minutes. |
| T = 15 min | Bleach sections that are to be light but not white, if any. |
| T = 20 min | Bleach sections that are to be a shade darker, if any. |
| T = 25 min | Bleach sections that are to be a next darker shade, if any. |
| T = 27 min | Bleach sections that are to be relatively darker, if any. |
| T = 28½ min | Bleach sections that are almost the original jeans color, if any. |
| T = 30 min | Immerse treated area of jeans or entire jeans in cold water, thoroughly rinsing out the bleach. This stops the bleach action and fixes the artwork. |

It should be understood that the above steps for forming the fade artwork or other fade pattern employ a uniform concentration of the hypochlorite salt containing composition that is applied at offset time intervals and inactivated by water immersion. Steps for forming the same fade artwork shown in FIGS. 2-5 employing multiple dispensers of varying strength concentrations of the composition are set forth below.

| | |
|---|---|
| T = 0 min | Apply the hypochlorite salt-containing composition to sections of the pattern to be treated. A first nozzle applies a full-strength composition to those sections of the pattern to be bleached out, i.e., to the base color of the fabric (usually white). A second nozzle applies a weaker strength composition, e.g., half strength, to those sections that are to be light but not white, if any. A third nozzle applies a still weaker strength composition, e.g., one third, to form a shade darker area, if any. A fourth nozzle applies a still weaker strength composition, e.g., one sixth, to form a next darker shade, if any. A fifth nozzle applies a still weaker strength composition, e.g., a tenth. Finally, a sixth nozzle applies the weakest strength composition, e.g., one twentieth. |
| T = 30 min | Immerse treated area of jeans or entire jeans in cold water, thoroughly rinsing out the bleach. This stops the bleach action and fixes the artwork. |

It should be understood that the number of discrete nozzles and the percentage strength compositions are variable and dependent upon the fade effect desired. For example, to minimize the entire processing time of a particular fabric, more powerful strength compositions may be employed to shorten the treatment time. Conversely, finer fade artwork or fade effects may be obtained using weaker concentrations, which would be useful on delicate fabrics. The techniques of the present invention may be employed in a variety of ways to achieve the creative results envisioned by the artists.

If desired, the artist can apply another color dye of choice to bleached-out or other sections of the artwork, such as a flower blossom. For example, in FIG. 5, a red flower blossom is applied to a flower-shaped, bleached-out portion of the artwork, designated by the reference numeral 80. After completing the application, the jeans can be handled in a customary manner, e.g., washed, dried or ironed. The artwork becomes part of the jeans color. With reference again to FIGS. 6A and 6B, it should be understood that the application of a different color can be accomplished by running the treated fabric 650 through the device 600. The different color, e.g., red, can be applied to a section, e.g., a bleached-out portion, of the fabric 650 through an appropriately configured template 660.

It should be understood that many modifications and variations of the present inventions are possible in light of the above teachings. While the invention has been described in its preferred embodiments, it is understood that the invention shall not be limited by thus description alone but in combination with the appended claims.

What is claimed is:

1. A fabric comprising a pattern of fades, said fades produced by a method comprising the steps of:

a) contacting a hypochlorite salt-containing composition on at least one portion of said fabric, wherein said hypochlorite salt-containing composition comprises an alkali metal hydroxide and a hypochlorite salt, and the weight concentration ratio of the alkali metal hydroxide over the hypochlorite salt in said hypochlorite salt-containing composition is no less than 1:12.5 and wherein the pH of said hypochlorite salt-containing composition is at least 11.8; and b) inactivating or removing said hypochlorite salt-containing composition from said at least one portion of said fabric to obtain a desired pattern of fades on said fabric, wherein said step of inactivating or removing said hypochlorite salt-containing composition is achieved by a cold water wash.

2. The fabric of claim 1, wherein said hypochlorite salt-containing composition in said step of contacting is applied at a fixed concentration.

3. The fabric of claim 1, wherein said hypochlorite salt-containing composition in said step of contacting is applied at varying concentrations.

4. The fabric of claims 2 or 3, wherein said step of contacting said hypochlorite salt-containing composition, at fixed or varying concentrations, to said fabric is automated.

5. The fabric of claim 1, wherein said at least one portion of said fabric is contacted with said hypochlorite salt-containing composition a plurality of times to create said pattern of fades on said fabric.

6. The fabric of claim 1, wherein said at least one portion of said fabric is contacted with said hypochlorite salt-containing composition once to create said pattern of fades on said fabric.

7. The fabric of claim 1, wherein said hypochlorite salt-containing composition is employed on said fabric at room temperature.

8. The fabric of claim 1, wherein said alkali metal hydroxide is sodium hydroxide and said hypochlorite salt is sodium hypochlorite.

9. The fabric of claim 8, wherein the concentration of said sodium hydroxide ranges from 0.5-5.5 weight percent.

10. The fabric of claim 8, wherein the concentration of said sodium hypochlorite ranges from 0.1-11.0 weight percent.

11. The fabric of claim 8, wherein the concentration of said sodium hypochlorite is 6% by weight.

12. The fabric of claim 1, wherein said hypochlorite salt-containing composition is a liquid or a gel.

13. The fabric of claim 12, wherein said liquid or gel of said hypochlorite salt-containing composition is applied to said fabric using an applicator selected from the group consisting of a gel stick, a spray jet and a fabric dye brush.

14. The fabric of claim 1, wherein at least a portion of said pattern of fades on said fabric is dyed with another color.

15. The fabric of claim 1, wherein at least a portion of said pattern of fades is totally bleached-out.

16. The fabric of claim 1, wherein said step of contacting said at least one portion of said fabric with said hypochlorite salt-containing composition is formed by an action selected from the group consisting of: free hand, template guide and machine operation.

17. The fabric of claim 1, wherein the duration of said step of contacting said at least one portion of said fabric with said hypochlorite salt-containing composition ranges from at least 1 minute to 30 minutes.

18. The fabric of claim 17, wherein a first duration time of less than about 15 minutes for said step of contacting produces partially bleached-out (dark) fades and a second duration time of approximately 30 minutes for said step of contacting produces totally bleached-out (white) fades.

19. The fabric of claim 1, wherein said fabric is made of a material selected from the group consisting of cotton, cotton/polyester, corduroy, rayon, canvas, linen, nylon, acrylic, flax, hemp, jute, ramie, polyester, polyamide, acrylic, polyvinyl chloride and polyolefin.

20. The fabric of claim 1, wherein said fabric is made of cotton.

21. The fabric of claim 19, wherein said fabric is shaped as an item selected from the group consisting of a garment or an apparel, carpet, tote bags, curtains, towels, bed clothing, indoor or outdoor protective covers, and wall-covering fabrics.

22. The fabric of claim 21, wherein said garment or apparel is a denim or jeans.

23. A method of producing a fabric having a pattern of fades according to claim 1, said method comprises:

a) contacting a hypochlorite salt-containing composition on at least one portion of said fabric, wherein said hypochlorite salt-containing composition comprises an alkali metal hydroxide and a hypochlorite salt; and b) inactivating or removing said hypochlorite salt-containing composition from said at least one portion of said fabric to obtain a desired pattern of fades on said fabric, wherein said step of inactivating or removing said hypochlorite salt-containing composition is achieved by a cold water wash.

24. The method of claim 23, wherein said step of contacting said fabric with said hypochlorite salt-containing composition is performed at a fixed concentration of said hypochlorite salt-containing composition.

25. The method of claim 23, wherein said step of contacting said fabric with said hypochlorite salt-containing composition is performed at varying concentrations of said hypochlorite salt-containing compositions.

26. The method of claims 24 or 25, wherein said step of contacting said hypochlorite salt-containing composition, at fixed or varying concentrations, to said fabric is automated.

27. The method of claim 23, wherein said step of contacting said fabric with said hypochlorite salt-containing composition is performed a plurality of times to create said pattern of fades on said fabric.

28. The method of claim 23, wherein said step of contacting said fabric with said hypochlorite salt-containing composition is performed once to create said pattern of fades on said fabric.

29. A kit for making a fabric having a pattern of fades thereon according to claim 1.

30. A fabric comprising a pattern of fades, said fades produced by a method comprising:

a) contacting a hypochlorite salt-containing composition on at least one portion of said fabric, wherein said hypochlorite salt-containing composition comprises an alkali metal hydroxide and a hypochlorite salt and the weight concentration ratio of the alkali metal hydroxide over the hypochlorite salt in said hypochlorite salt-containing composition ranges from about 1:5 to about 5:1 and wherein the pH of said hypochlorite salt-containing composition is at least 11.8; and b) inactivating or removing said hypochlorite salt-containing composition from said at least one portion of said fabric to obtain a desired pattern of fades on said fabric, wherein said step of inactivating or removing said hypochlorite salt-containing composition is achieved by a cold water wash.

31. A fabric comprising a pattern of fades, said fades produced by a method comprising the steps of:

a) contacting a hypochlorite salt-containing composition on at least one portion of said fabric, wherein said hypochlorite salt-containing composition comprises an alkali metal hydroxide and a hypochlorite salt, and the weight concentration ratio of the alkali metal hydroxide over the hypochlorite salt in said hypochlorite salt-containing composition ranges from about 1:3 to about 1:1 and wherein the pH of said hypochlorite salt-containing composition is at least 11.8; and b) inactivating or removing said hypochlorite salt-containing composition from said at least one portion of said fabric to obtain a desired pattern of fades on said fabric, wherein said step of inactivating or removing said hypochlorite salt-containing composition is achieved by a cold water wash.

* * * * *